US009359685B2

(12) United States Patent
Choi et al.

(10) Patent No.: US 9,359,685 B2
(45) Date of Patent: Jun. 7, 2016

(54) FORMATION OF CONDUCTIVE POLYMERS USING NITROSYL ION AS AN OXIDIZING AGENT

(75) Inventors: Kyoung-Shin Choi, West Lafayette, IN (US); Yongju Jung, West Lafayette, IN (US); Nikhilendra Singh, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 665 days.

(21) Appl. No.: 13/641,778

(22) PCT Filed: Jul. 2, 2010

(86) PCT No.: PCT/US2010/040882

§ 371 (c)(1),
(2), (4) Date: Nov. 26, 2012

(87) PCT Pub. No.: WO2011/133170

PCT Pub. Date: Nov. 27, 2011

(65) Prior Publication Data

US 2013/0092546 A1 Apr. 18, 2013

Related U.S. Application Data

(60) Provisional application No. 61/326,391, filed on Apr. 21, 2010.

(51) Int. Cl.

| | |
|---|---|
| ***C25D 9/02*** | (2006.01) |
| ***H01B 1/12*** | (2006.01) |
| ***C25D 5/54*** | (2006.01) |

(Continued)

(52) U.S. Cl.
CPC .. *C25D 9/02* (2013.01); *C25D 5/54* (2013.01); *C25D 11/00* (2013.01); *C25D 15/00* (2013.01); *H01B 1/127* (2013.01)

(58) Field of Classification Search
CPC ..... C25D 15/00; C25D 5/54; C25D 9/02; C25D 11/00; H01B 1/127
See application file for complete search history.

(56) References Cited

U.S. PATENT DOCUMENTS 4,636,430 A * 1/1987 Moehwald ..... 428/304.4
2006/0008745 A1 1/2006 Sasaki et al.

(Continued)

FOREIGN PATENT DOCUMENTS

EP 2096648 A1 9/2009

OTHER PUBLICATIONS

International Search Report for related international application No. PCT/US2010/040882, report dated Apr. 11, 2011.

(Continued)

*Primary Examiner* — Ciel Thomas
(74) *Attorney, Agent, or Firm* — Miller, Matthias & Hull LLP

(57) ABSTRACT

A method of forming a conductive polymer deposit on a substrate is disclosed. The method may include the steps of preparing a composition comprising monomers of the conductive polymer and a nitrosyl precursor, contacting the substrate with the composition so as to allow formation of nitrosyl ion on the exterior surface of the substrate, and allowing the monomer to polymerize into the conductive polymer, wherein the polymerization is initiated by the nitrosyl ion and the conductive polymer is deposited on the exterior surface of the substrate. The conductive polymer may be polypyrrole.

10 Claims, 9 Drawing Sheets

(51) Int. Cl.
*C25D 11/00* (2006.01)
*C25D 15/00* (2006.01)

(56) References Cited

U.S. PATENT DOCUMENTS

2007/0089845 A1* 4/2007 Sotzing et al. ..... 162/157.2
2009/0020431 A1* 1/2009 Voccia et al. ..... 205/77
2009/0272560 A1 11/2009 Tsukasa
2012/0183620 A1* 7/2012 Cho et al. ..... 424/490

OTHER PUBLICATIONS

International Preliminary Report on Patentability for related international application No. PCT/US2010/040882, report dated Nov. 1, 2012.

* cited by examiner

FORMATION OF CONDUCTIVE POLYMERS USING NITROSYL ION AS AN OXIDIZING AGENT

CROSS REFERENCE TO RELATED APPLICATIONS

This application is a U.S. National Stage filing under 35 USC §371 of International Patent Application No. PCT/US2010/040882 filed on Jul. 2, 2010, which claims priority under 35 USC §119(e) to U.S. Provisional Application Ser. No. 61/326,391 filed on Apr. 21, 2010.

GOVERNMENT LICENSE RIGHTS

This invention was made with government support under Grant No. DF-FG02-05ER15752, awarded by the U.S. Department of Energy. The government has certain rights in the invention.

BACKGROUND

1. Technical Field

A method for formation of conductive polymers using an in situ generated nitrosyl ion as an oxidizing agent is disclosed. Nitrosyl ion is generated either electrochemically or chemically. Application of the resulting polymers and polymer-inorganic composite materials thus generated in various areas (e.g., energy conversion/storage, coatings, sensors, drug delivery, and catalysis) is also disclosed.

2. Description of the Related Art

Conducting polymers combining the desirable features of organic polymers and electronic properties of semiconductors are attractive materials for use in energy conversion/storage, optoelectronics, coatings, and sensing technologies. In general, polymerization of conducting polymers is initiated by chemical or electrochemical oxidation of monomers to radicals, followed by radical coupling and chain propagation. While chemical oxidation involves the use of oxidizing agents, such as $FeCl_3$, electrochemical oxidation is typically achieved by applying an anodic bias (bias that causes oxidation reaction to occur at the working electrode) to a conducting substrate immersed in a monomer solution (anodic electropolymerization). The electrochemically initiated polymerization is generally used to prepare film- or electrode-type conducting polymers, as it localizes polymerization to working electrodes with convenient control over film thickness and morphology.

In a further development, conducting polymers have been utilized as a matrix to embed or disperse metal particles (e.g., Cu, Au, Ag, Ni, Ru, Ir, Pt, Co, Pd, Fe) to form conductive polymer-metal composite electrodes for use in various electrochemical applications (e.g., sensors and electrocatalysts). Typically, these hybrid electrodes are prepared by a two-step electrodeposition process: electropolymerization (anodic deposition) followed by metal deposition (cathodic deposition). This two-step process not only makes the preparation cumbersome and expensive but also limits the types and qualities of the metal-polymer composite thus generated. However, because anodic electropolymerization and cathodic metal deposition require an oxidation and a reduction reaction at the working electrode, respectively, with significantly different and often incompatible ranges of potentials, one-step process for preparing metal-conducting polymer hybrid films has yet to be developed.

Another important class of conducting polymer-based composite materials can be prepared when a conductive polymer is combined with high surface area mesoporous silica materials. Mesoporous silica materials have been utilized for various applications (catalysis, sensing, drug delivery, adsorption and separation) due to their uniform mesoporous features as well as high surface areas. When a conductive polymer layer is deposited on the mesopore walls, the physicochemical properties as well as the surface nature of the silica (e.g. hydrophilicity and surface charge) can be modified, which allows for adsorption and/or immobilization of a wide range of molecules/species on the mesopore walls, thereby significantly broadening the application of the mesoporous materials. In addition, a conductive polymer coating may convert the insulating mesoporous silica materials into semiconducting composites that can be used for sensors and electrocatalysis.

In order to obtain silica-polymer composites retaining uniform and accessible mesopores, a thin polymer coating should be introduced on the mesopore walls in a uniform manner without clogging the mesopore entrances. When monomers and initiators (e.g. oxidizing agents) are mixed with mesoporous silica particles in one reaction chamber, polymerzation occurs predominantly in bulk solution or on the surface of silica particles because the diffusion of monomers or initiators into the pores is less favored. This clogs the pore entrances and hinders the formation of high quality composite mesoporous particles, and/or creates an undesirable mixture of pure polymer particles and composite particles in solution.

To achieve desirable polymerization within the mesopores, several approaches have been developed, which commonly require a two-step procedure. Specifically, monomers are first adsorbed within the silica mesopores, and are then transferred to a different chamber to be mixed with initiators. Because the interaction between the monomers and initiators in the solution phase is limited, undesirable bulk polymerization may be significantly suppressed. Again, although such two-step processes make the preparation cumbersome and expensive, one-step formation and deposition of conductive polymers on mesoporous silica walls has yet to be developed.

SUMMARY OF THE DISCLOSURE

In satisfaction of the aforementioned needs, a method of forming a conductive polymer deposit on a substrate is disclosed. The method may include the steps of preparing a composition comprising monomers of the conductive polymer and a nitrosyl precursor, contacting the substrate with the composition so as to allow formation of nitrosyl ion on the exterior surface of the substrate, and allowing the monomers to polymerize into the conductive polymer, wherein the polymerization is initiated by the nitrosyl ion and the conductive polymer is deposited on the exterior surface of the substrate. The conductive polymer may be polypyrrole.

In one embodiment, the nitrosyl ion may be generated electrochemically. To that end, the substrate may be a working electrode and the method may further include the step of providing auxiliary and optional reference electrode in contact with the composition, and applying an electric potential bias between the working and auxiliary electrodes. To electrochemically generate nitrosyl ion, the composition may include a nitrate, such as sodium nitrate as the nitrosyl precursor and the composition may have a pH value of less than about 7. In a refinement of this embodiment, the composition may further include a metal salt, such as tin chloride, and the method may further include the step of forming and depositing metal particles as well as conductive polymers on the substrate. The metal particles may be evenly coated on the exterior surface of the conductive polymer in some examples.

In another embodiment of this disclosure, the nitrosyl ion may be generated chemically on the surface of the substrate. To that end, the substrate may have a proton donating surface (e.g. substrates with surface hydroxyl groups). For example, the substrate may be mesoporous silica or aluminosilica. The composition may include a nitrite, such as sodium nitrite, as the nitrosyl precursor. The conductive polymer may form a substantially continuous coating on the surface of the substrate to render the substrate conductive to electricity. Moreover, the mesoporous structure of the substrate may remain substantially unchanged after the formation and deposition of the conductive polymer on the substrate.

Other advantages and features of the disclosed methods and the substrate-conductive polymer composite will be described in greater detail below. It will also be noted here and elsewhere that the composite or method disclosed herein may be suitably modified to be used in a wide variety of application by one of ordinary skill in the art without undue experimentation.

BRIEF DESCRIPTION OF THE DRAWINGS

For a more complete understanding of the disclosed composites and methods, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed composite or method which render other details difficult to perceive may have been omitted. It should be understood, of course, that this disclosure is not limited to the particular embodiments illustrated herein.

DETAILED DESCRIPTION OF THE DISCLOSURE

This disclosure is generally related to a method of forming a conductive polymer using nitrosyl ion ($NO^+$) as an oxidizing agent. Nitrosyl ion may be formed by the reaction between nitrite ion and proton. Thus, when nitrite salts, proton donors, and monomers are mixed in solution, polymerization occurs in solution. If, however, generation of nitrosyl ion can be localize on a substrate, subsequent polymerization may also be localized on the substrate, thereby forming a conductive polymer deposit on the substrate.

For example, nitrite ions may be generated electrochemically by the reduction of nitrate ions on a working electrode. If nitrite ions are electrochemically generated in a solution containing nitrate ions, proton donors, and monomers, NO will be formed only on the working electrode (substrate), resulting in polymerization on the working electrode surface. On the other hand, when a solution contains only monomers and nitrite ions, and a substrate is immersed in the solution as a proton donor, NO will be formed only on the surface of the substrate. As a result, polymerization will occur on the surface of the substrate.

Figure 1:
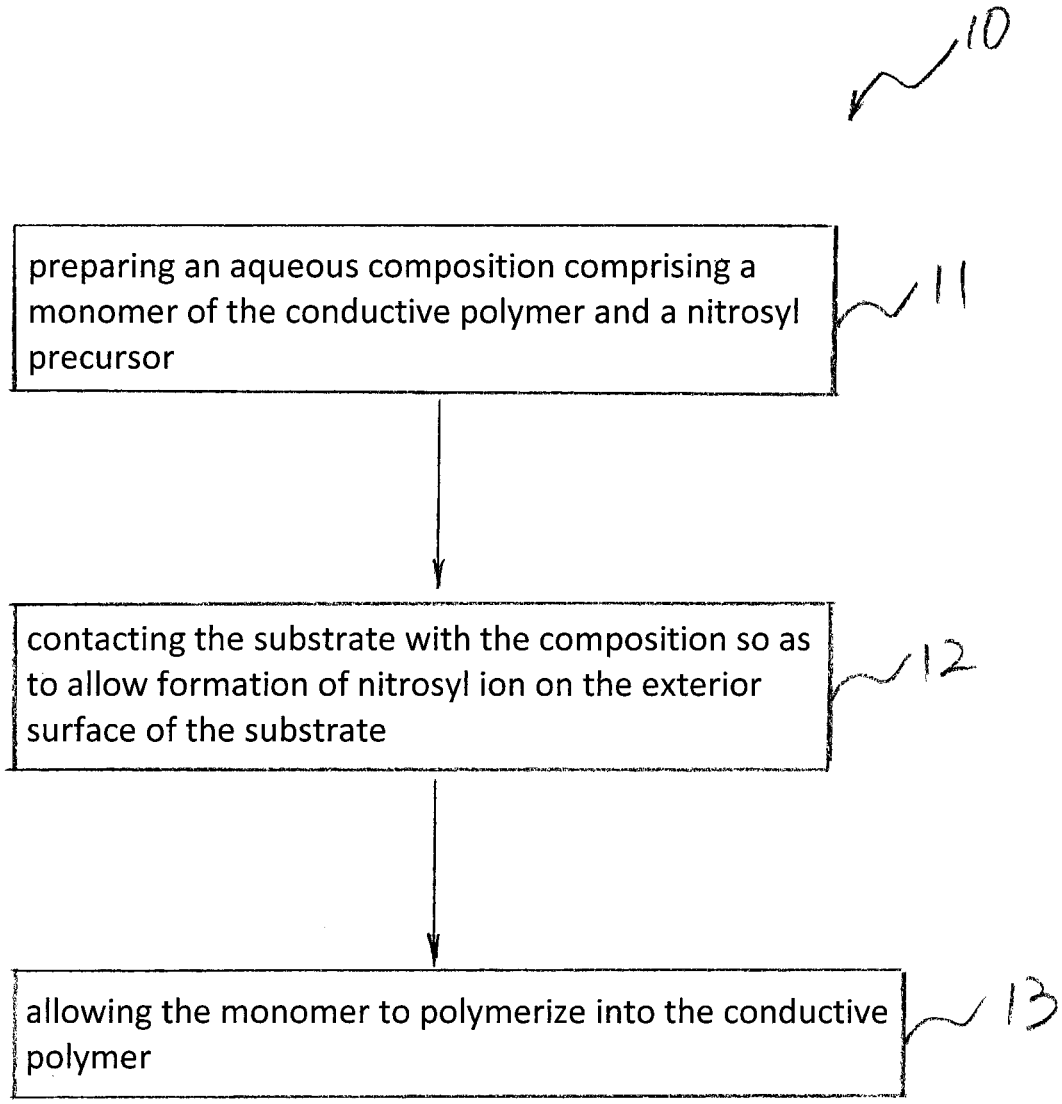
FIG. 1 is a block diagram of a method for forming a conductive polymer deposit on a substrate according to this disclosure.

Turning to FIG. 1, the disclosed method 10 may generally include the steps of preparing a composition comprising a monomer of the conductive polymer and a nitrosyl precursor 11, contacting the substrate with the composition so as to allow formation of nitrosyl ion on the exterior surface of the substrate 12, and allowing the monomer to polymerize into the conductive polymer 13. The polymerization is initiated by the nitrosyl ion, which may be generated in situ on the substrate electrochemically or chemically. The conductive polymer maybe deposited on the exterior surface of the substrate.

Many conductive polymers may be used in the disclosed method. On exemplary conductive polymer is polypyrrole. The conductive polymer may also be polythiophene. Mixtures of different conductive polymers (and corresponding monomers) may also be used. It is to be understood that the type of the conductive polymer should not be construed as limiting the scope of this disclosure. Moreover, the composition may be aqueous-based or organic solvent-based, or the composition may include a mixture of water and organic solvent. The composition may be solution, emulsion, or suspension.

According to a first embodiment of the disclosed method, the nitrosyl ion is generated electrochemically, which allows for formation and deposition of the conductive polymer on a working electrode. In particular, the nitrosyl ion is generated electrochemically by reduction of nitrate ions under cathodic bias, which allows for cathodic deposition of the conductive polymer, such as polypyrrole.

The formation and deposition of the conducting polymer may be achieved by coupling two redox reactions. The first reaction is electrochemical generation of the oxidizing agent ($NO^+$). The electrochemical generation of $NO^+$ ions may involve reduction of nitrate ions ($NO_3^-$) to nitrous acid ($HNO_2$) [Eq. (1)]. Because $HNO_2$ is amphoteric, various species may be generated depending on the pH of the solution. Under mild acidic conditions, $HNO_2$ is the major species but it dissociates into $NO_2^-$ and $H^+$ as the pH increases. Under strong acidic conditions, on the other hand, $HNO_2$ reacts with $H^+$ ions to generates the $NO^{30}$ ion [Eq. (2)], which is a strong oxidizing agent.

$$NO_3^- + 3H^+ + 2e \leftrightarrow HNO_2 + H_2O \quad (1)$$

$$HNO_2 + H^+ \leftrightarrow H_2NO_2^+ \leftrightarrow NO^+ + H_2O \quad (2)$$

The second reaction is chemical oxidation of pyrrole by $NO^+$ ions, which in turn initiates the polymerization process. Since the oxidizing agents are generated in situ only at the working electrode, polymerization occurs predominantly on the working electrode, which results in deposition of electrode-type or film-type conducting polymers at the cathode instead of in the solution phase.

Without wishing to be limited to any particular theory, it is contemplated that such a process may be used to assemble conductive polymer electrodes and conducting polymer-based hybrid electrodes with improved features. For example, the disclosed method allows the conductive polymer to be deposited on substrates that are not stable under anodic deposition conditions. Further, the nucleation and growth pattern of the conductive polymers during cathodic deposition are different from those of anodic deposition, which results in improved micro- and nano-scale polymer morphologies. Finally, the disclose method allow electrodeposition of metal-conducting polymer hybrid electrodes in one-step because both the polymerization and metal reduction reactions can occur under the same cathodic conditions. As disclosed herein, the use of cathodic polymerization for the production of high-surface-area polypyrrole electrodes and the one-step preparation of tin-polypyrrole composite electrodes is both effective and time/energy conserving. The resulting tin-polypyrrole electrodes may be used as anodes in Li-ion batteries.

In a non-limiting example, a depositing composition (plating solution) is prepared as an aqueous solution containing 0.4 M $HNO_3$, 0.5 M $NaNO_3$, and 0.2 M pyrrole (the pH of the freshly made solution was 0.4). The working electrode may be copper foil and the counter electrode may be 1000 Å of platinum deposited on 200 Å of titanium on a glass slide by sputter coating. Electrodeposition may be carried out at E=−0.65 V versus an Ag/AgCl/4M KCl reference electrode at room temperature. Efficient deposition of polypyrrole can be achieved when the pH is maintained at no more than 1.5. In such a strongly acidic environment, a considerable amount of $NO^+$ species can be generated by electrochemical reduction of $NO_3^-$.

Figure 2:
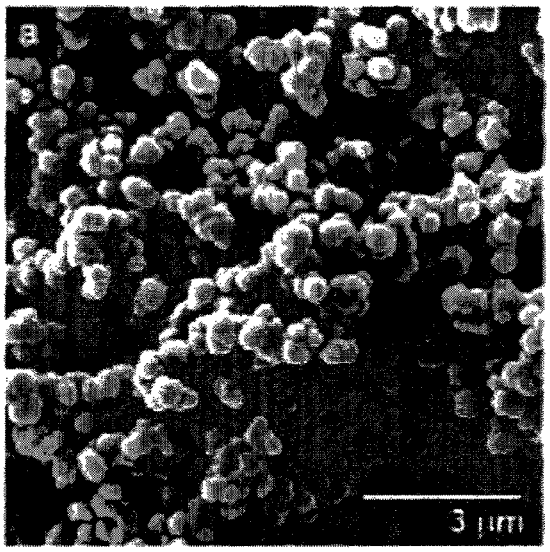
FIG. 2 is an SEM image of polypyrrole deposited on a substrate using catohdic bias obtained through a first embodiment of the disclosed method.
Figure 3:
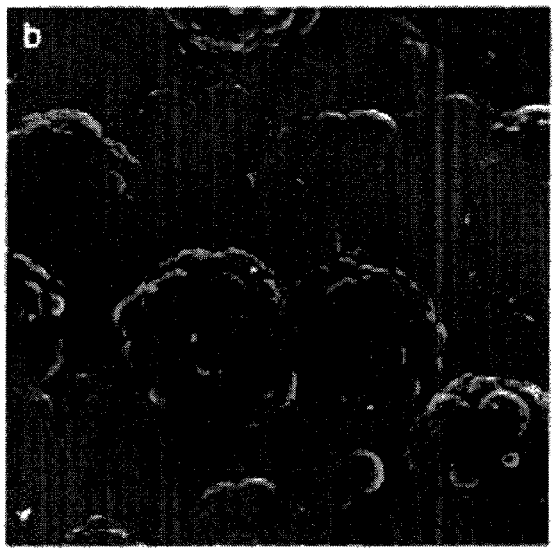
FIG. 3 is an SEM image of polypyrrole deposited on a substrate using anodic bias obtained through a prior art method.

Turning to FIG. 2, scanning electron microscopy (SEM) shows that the polypyrrole deposit contains spherical particles with diameters ranging from 50 to 200 nm in a form of a three-dimensional porous network, which can be beneficial for applications that require conducting-polymer electrodes with high surface areas. Such morphology is distinct from anodically prepared polypyrrole deposit which typically has two-dimensional planar surface morphologies. An SEM image of polypyrrole deposited anodically (E=+0.80 V vs. Ag/AgCl) using the same plating solution is shown in FIG. 3 for comparison purposes (a platinum working electrode was used in this case, as copper foil immediately oxidizes upon application of an anodic potential). Although the anodically generated polypyrrole deposit displays similar spherical features on the surface, its surface is essentially two dimensional in nature and lacks mesoporosity.

Various conducting polymer-based composite electrodes can be prepared through the method described above. To that end, the depositing composition may include a metal salt, which may form inorganic particles electrochemically derived from the metal salt. The inorganic particles may include, but are not limited to, metals, metal oxides, metal sulfides, metal selenides, metal tellurides. The inorganic particles may be deposited on the electrode with the conducting polymer. In a non-limiting example, tin-polypyrrole hybrid electrodes may be prepared by simply adding 0.1 M $SnCl_2$ to the plating solution used to deposit polypyrrole. Cathodic deposition may be carried out at the identical potential used to deposit polypyrrole films with the bath temperature increased to 45° C. to help dissolution of $SnCl_2$.

Figure 4:
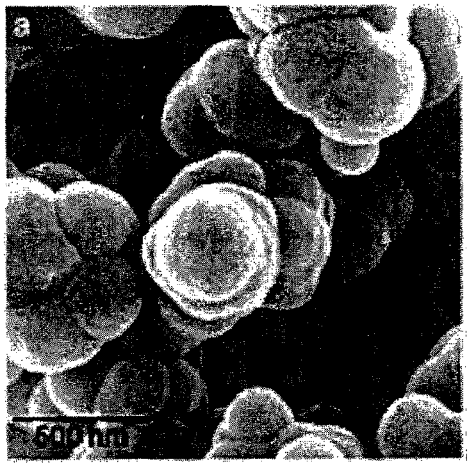
FIG. 4 is an enlarged SEM image of the polypyrrole particles shown in FIG. 2.
Figure 5:
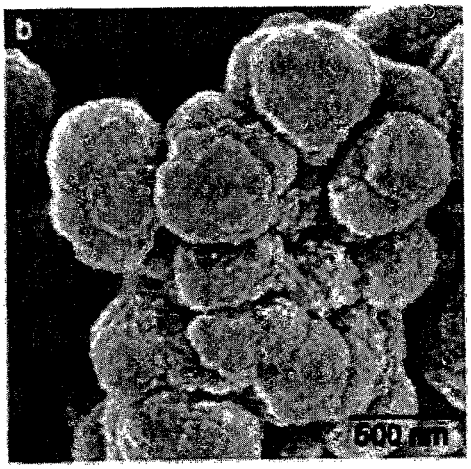
FIG. 5 is an SEM image of polypyrrole particles co-deposited with tin on a cathode substrate obtained through the first embodiment of the disclosed method.
Figure 6:
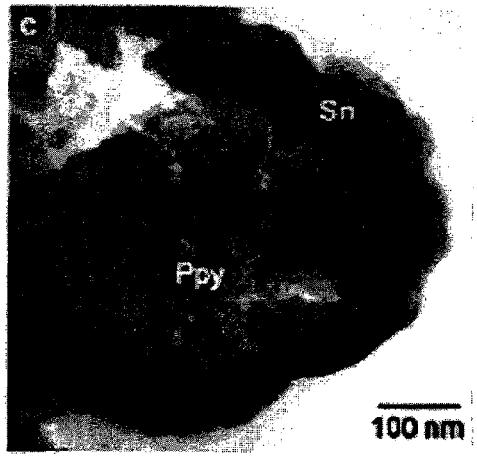
FIG. 6 is a cross-sectional TEM image of a polypyrrole-tin particle shown in FIG. 5.
Figure 7:
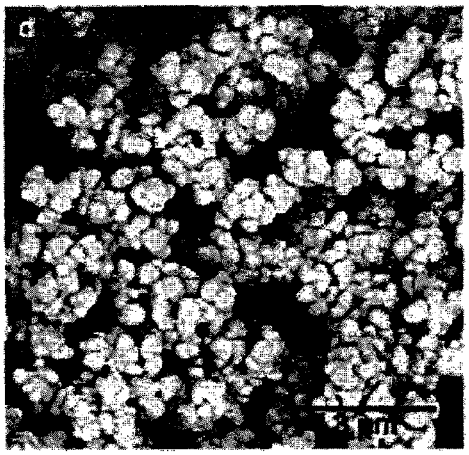
FIG. 7 is a BSE image of the polypyrrole-tin particles shown in FIG. 5.
Figure 17:
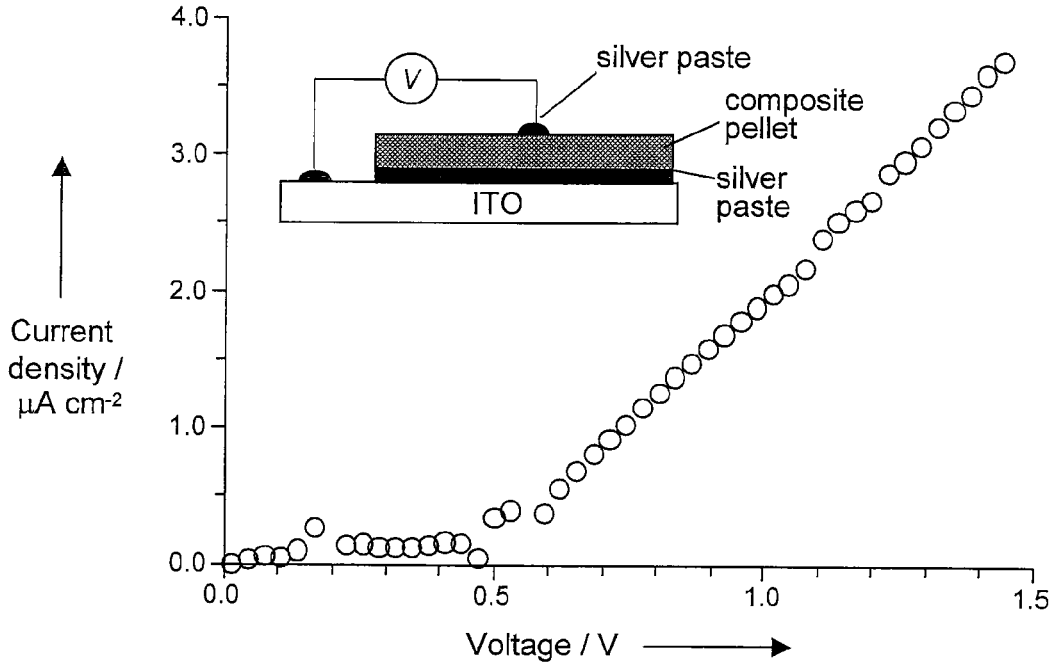
FIG. 17 illustrates conductivity measurement of the silica-polypyrrole composite obtained through the second embodiment of the disclosed method.

Turning now to FIG. 4, SEM images of the tin-polypyrrole hybrid electrodes show that the hybrid film maintained the original polypyrrole framework composed of polypyrrole nanospheres creating a porous network. However, as illustrated in FIG. 5, the surface of the polypyrrole spheres became noticeably rough because of the presence of tin particles. A transmission electron microscopy (TEM) image of a cross-sectioned tin-polypyrrole sphere shows that Sn particles are evenly coated on the surface of the polypyrrole spheres (FIG. 6). Further analysis of multiple cross-sectional TEM images suggests that the thickness of the tin coating layer on the polypyrrole spheres may range from 25 to 100 nm. The uniformity of tin deposition on the polypyrrole spheres may also be confirmed by back-scattered electron (BSE) image, in which tin particles with higher electron density would appear brighter than polypyrrole spheres. As illustrated in FIG. 17, the BSE images of tin-polypyrrole spheres shows substantially even contrast, instead of scattered and isolated brighter spots on the polypyrrole spheres, which indicates that the tin nanoparticles may be deposited uniformly on all of the polypyrrole spheres.

The resulting tin-polypyrrole electrodes may be a good candidate for an anode for Li-ion batteries. Tin metal has been used in high-energy-density Li-ion batteries because of its high theoretical specific capacity for lithium (993 $mAhg^{-1}$, corresponding to the formation of $Li_{4.4}Sn$). However, its significant volume change upon insertion and extraction of lithium (up to 300%) may cause pulverization resulting in poor cycle performance, and thus limit the use of tin anodes in commercial Li-ion batteries. One of the most common approaches to overcoming this problem is to combine tin with buffer matrix that can accommodate the volume change of tin during cycling. Decreasing the size and increasing the degree of dispersion of metallic tin in the matrix can be beneficial for improving the cycle properties, because the volume changes caused by smaller domains can be more easily accommodated by the matrix. Moreover, the use of tin nanoparticles can also be advantageous for increasing the rate capability, as it decreases the diffusion length of $Li^+$ ions to complete the alloying and de-alloying processes.

To combine the desirable feature of tin and polypyrrole deposits as electrode materials, the cathodic polymerization-deposition method disclosed herein allows preparation of tin-ppy hybrid electrodes with superior properties than regular tin electrodes for use as a Li-ion battery anode. Without wishing to be bound by any particular theory, it is contemplated that the polypyrrole spheres may function as a buffer matrix that elastically accommodates the volume expansion of tin nanoparticles during cycling. In addition, a thin tin nanoparticle deposit on a porous polypyrrole network may facilitate Li-ion diffusion in and out of the anode, thus resulting in improved rate capabilities. Further, while tin anodes are prepared by mixing tin particles with a polymer binder and conducting additives (three-component system) in existing methods, the disclosed method uses a two-component system (tin and conductive polymer without any binder) because tin particles were electrode-posited with an excellent adhesion to the polypyrrole spheres and good electrical continuity between the particles within the tin layers. As a result, the tin content in the hybrid electrode could be increased up to 95 wt %. In some examples discussed herein, the tin content in the hybrid electrodes used for electrochemical characterization is 88 wt % (determined by inductively coupled plasma-atomic emission spectroscopy).

Figure 8:
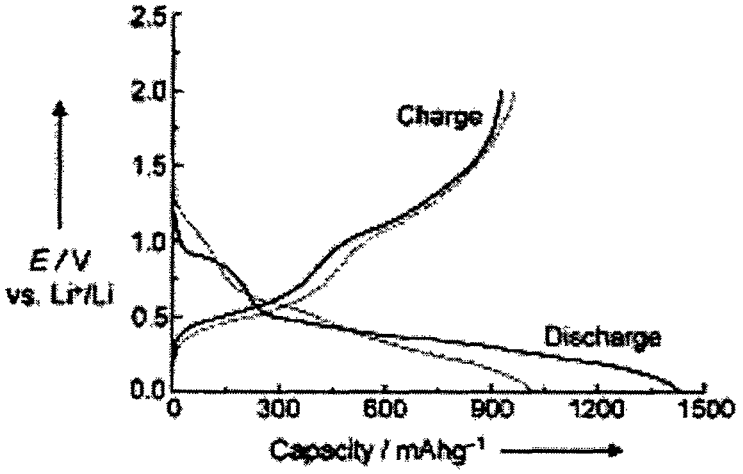
FIG. 8 illustrates first (solid line) and second (broken line) charge-discharge curves of the cathode-polypyrrole-tin composite obtained through the first embodiment of the disclosed method.

The potential profiles of the tin-polypyrrole hybrid electrodes for the initial two cycles (formation step) obtained at a rate of 0.2 C (1 C=993 $mAg^{-1}$) are shown in FIG. 8. The coulombic efficiency for the first cycle (64%) may be relatively low, probably as a result of the high irreversible capacity observed during the first discharge process. This is typical behavior for systems containing nanostructured electrochemically active materials that create large electrode/electrolyte contact areas. The high coulombic efficiency for the second cycle (94%) indicates that a stable solid-electrolyte interphase (SEI) is formed during the first cycle. For comparison purposes, the potential profiles of a pure tin electrode, which was electrochemically deposited using a sulfate bath and contained the same amount of tin as the hybrid electrode, indicate a drastic capacity decrease during the second discharge process.

Figure 9:
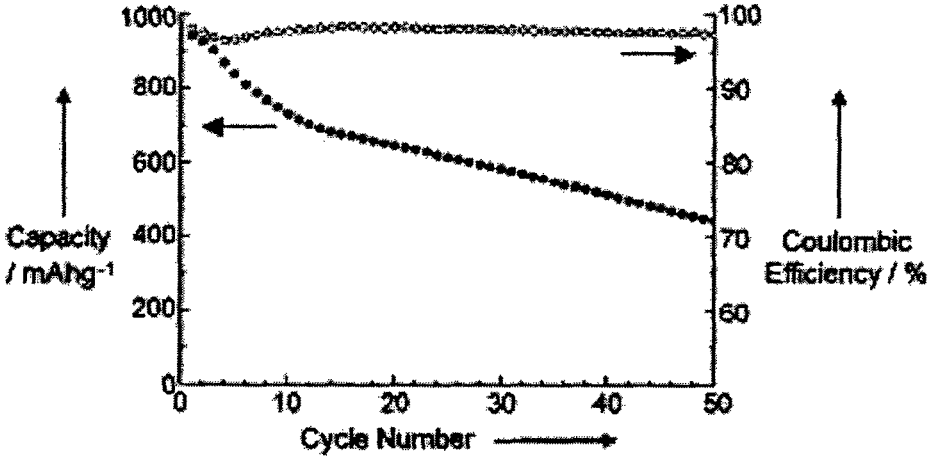
FIG. 9 illustrates charge capacity (solid dot) and coulombic efficiency (hollow dot) curves of the cathode-polypyrrole-tin composite (at 1 C rate after formation) obtained through the first embodiment of the disclosed method.

The cycle performance and coulombic efficiency of the tin-polypyrrole hybrid electrode up to 50 additional cycles after the formation step is shown in FIG. 9. A rate of 1 C was used for both charging and discharging processes. The initial capacity of the hybrid electrode, 942 $mAhg^{-1}$ of Sn, corresponds to 829 $mAhg^{-1}$ of composite (88 wt % of tin). This value is approximately 2.5 times larger than that of commercialized graphite anodes (ca. 330 $mAhg^{-1}$ of composite), which indicates that with proper optimization the tin-polypyrrole hybrid electrode may be used as anode material for future high-energy-density Li-ion batteries. After 50 cycles, the tin-polypyrrole hybrid electrode showed a capacity retention of 47%, which is an improvement over pure tin electrodes with a comparable thickness (ca. 10 mm), typically showing a significantly capacity fading within a few cycles. It is contemplated that the disclosed polypyrrole deposit provided high surface area to deposit tin as thin coating layers, which effectively suppresses pulverization and enhances the cycling property of tin. Further, the one-step preparation of tin-polypyrrole electrodes may be more time-conserving and cost effective than two-step electrodeposition of current hybrid electrodes.

Figure 10:
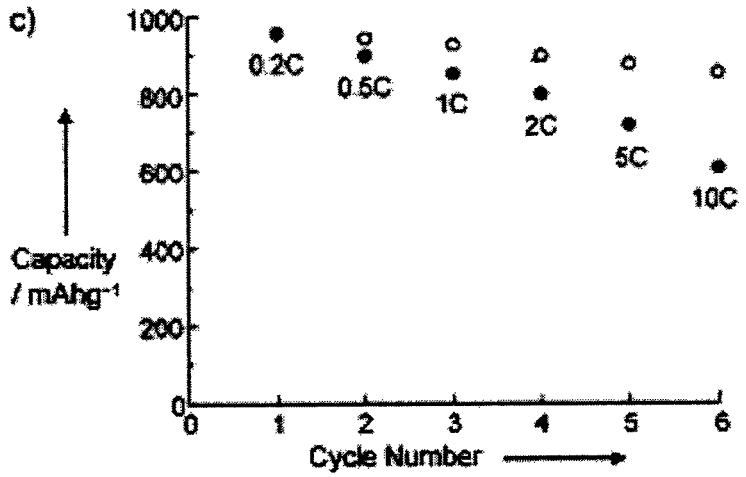
FIG. 10 illustrates charge capacity of the cathode-polypyrrole-tin composite obtained through the first embodiment of the disclosed method at a constant rate of 0.2 C (hollow dot) and at variable rates (solid dot)
Figure 11:
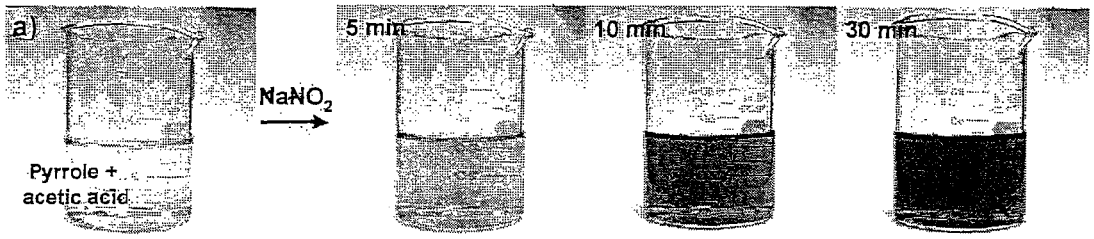
FIG. 11 is a photographic demonstration of polymerization of polypyrrole in a solution containing 0.1 M pyrrole, 0.1 M $NaNO_2$, and 0.2 mM acetic acid.
Figure 12:
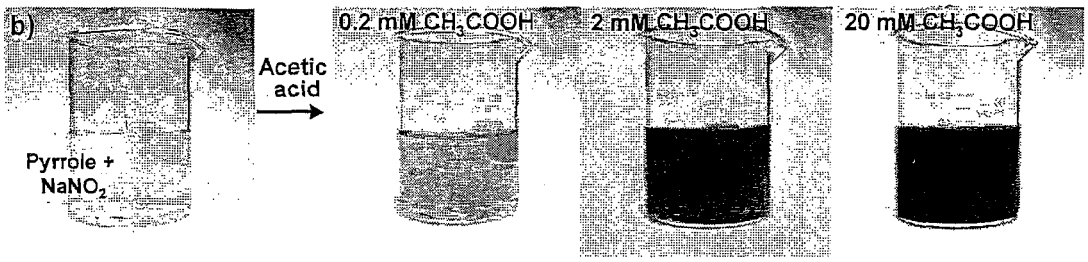
FIG. 12 is a photographic demonstration of polymerization of polypyrrole in a solution containing 0.1 M pyrrole, 0.1 M $NaNO_2$, and various concentrations of acetic acid.

FIG. 10 illustrates the rate capabilities of the tin-polypyrrole hybrid electrodes with varying C rates, together with rate capabilities with a fixed discharge/charge rate of 0.2 C through all cycles for comparison purpose. As shown in FIG. 10, when the C rate is increased from 0.2 to 5 C, only an 18% reduction of the charge capacity was observed (from 875 to 718 $mAhg^{-1}$), which indicates that the tin-polypyrrole hybrid electrodes may be used as high-power-density as well as high energy-density anodes. This improved rate capability may be a result of reduction of the diffusion length of Li ions required for complete utilization of tin in the hybrid structure. Moreover, further enhancements in capacity retention and rate capability may be achieved with proper optimization (e.g., composition and morphology tuning in the hybrid electrodes, addition of a protective coating on the tin layer).

The above example demonstrates that the cathodic polymerization method may be used to produce a variety of metal-conductive polymer composite electrodes through a one-step process because a broad range of metals can be cathodically deposited at the same bias applied to generate $NO^+$. During such a co-deposition process, new composite morphology may be achieved because metal deposition and polymer deposition may interact with each other, thus altering their nucleation and growth patterns. In addition, co-deposition may increase the uniformity and degree of metal dispersion within the conducting-polymer matrix compared to a two-step deposition (anodic polymerization followed by metal deposition).

According to a second embodiment of the disclosed method, $NO^+$ ions may be chemically formed by mixing $NO_2^-$ and $H^+$ (Eq. 3). $HNO_2$ is amphoteric, and further reacts with $H^+$ ions in an acidic environment, which results in the generation of the $NO^+$ ions. (Eq. 4).

$$NO_2^- + H^+ \Leftrightarrow HNO_2 \quad (3)$$

$$HNO_2 + H^+ \Leftrightarrow H_2NO_2^+ \Leftrightarrow NO^+ + H_2O \quad (4)$$

The formation of $NO^+$ ions in an aqueous medium using Eqs. 3-4 and their ability to polymerize pyrrole is demonstrated in FIG. 5*a*. The solution contains 0.1 M pyrrole and 0.2 mM $CH_3COOH$ as the proton donor. Upon addition of $NaNO_2$, the color of the clear solution changes to yellow and to dark brown over time, indicating a gradual progression of polypyrrole formation. The degree or rate of polymerization can be modified by changing the concentration of $CH_3COOH$ or pH, which affects the chemical equilibrium shown in Eq. 4 and varies the amount of $NO^+$ ions generated. FIG. 5*b* illustrates pH-dependent polymerization of polypyrrole where increasing the concentration of $CH_3COOH$ expedites the formation of polypyrrole.

The substrate in the second embodiment may have a proton-donating surface as the proton source to react with nitrite ions to generate nitrosyl ions. For example, the proton -donating surface may be a surface having surface —OH groups, such as mesoporous silica or aluminosilica. The $pK_a$ of silanol groups on the silica surface which ranges from 4.7 to 4.9, which is similar to the $pK_a$ of $CH_3COOH$, which was used as the proton source to generate $NO^+$ ions for polymerization shown in FIGS. 5*a-b*. Therefore, it is contemplated that selective deposition of polypyrrole on the surface of mesoporous silica may be achieved if the silica surface is used as the only proton source (Eqs. 5-7) to react with $NO_2^-$ ions to form $NO^+$ ions.

$$NO_2^- + \text{Silica-OH} \Leftrightarrow HNO_2 + \text{Silica-O}^- \quad (5)$$

$$HNO_2 + \text{Silica-OH} \Leftrightarrow H_2NO_2^+ + \text{Silica-O}^- \quad (6)$$

$$HNO_2 + H^+ \Leftrightarrow H_2NO_2^+ \Leftrightarrow NO^+ + H_2O \quad (7)$$

Figure 13:
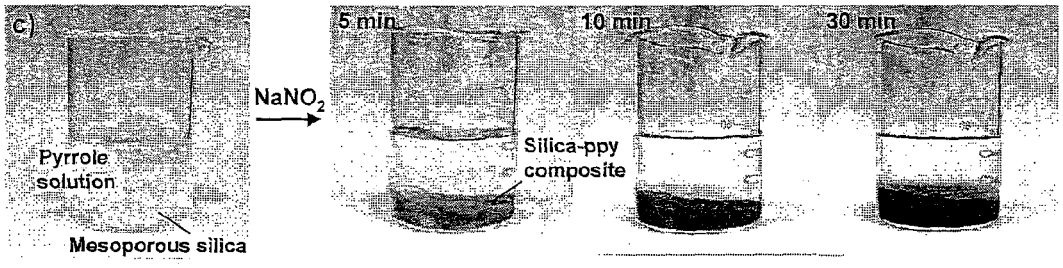
FIG. 13 is a photographic demonstration of polymerization of polypyrrole on a mesoporous silica substrate according to a second embodiment of the disclosed method.

FIG. 13 illustrates a polymerization reaction carried out in 50 mL 0.1 M pyrrole solution containing 600 mg of MSU-H silica particles that have an ordered 2D hexagonal mesoporous structure (pore size, ca. 9.3 nm). MSU-His a non-limiting example of mesoporous silica, which may be obtained commercially from Sigma-Aldrich, http://www.sigmaaldrich.com/united-states.html. Upon addition of 1 mL 5.0 M $NaNO_2$ solution, MSU-H particles present at the bottom of the beaker shows an immediate color change from white to dark pink, indicating the formation of polypyrrole on the silica surface caused by the in situ generation of $NO^+$ ions. The color becomes darker brown over time as the degree of polymerization increased. No visible polymerization was observed in the bulk solution phase since the amount of $NO^+$ ions in the pH neutral solution is negligible. In this reaction, selective polymerization within the silica mesopores is achieved even though the monomers and initiators are present in the same beaker (one-pot synthesis). This is because oxidizing agents are generated in situ only on the silica surface. Even if $NO_2^-$ ions are more readily available in the bulk solution, they are converted to $NO^+$ ions only when they react with the silica surface. Therefore, localized generation of $NO^+$ ions is achieved without needing any effort to preconcentrate the oxidizing agent within the pores as required in the existing two-step process.

Figure 14:
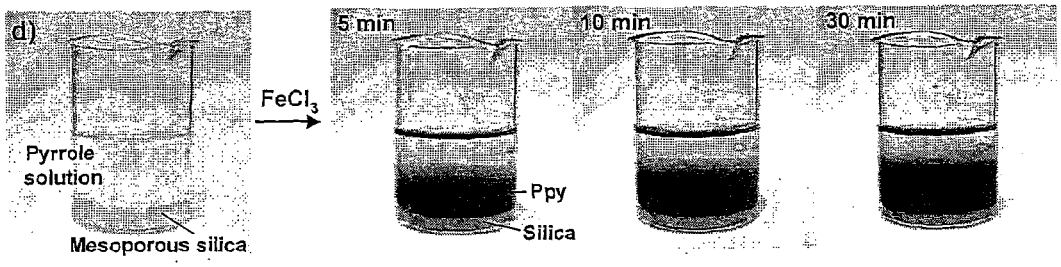
FIG. 14 is a photographic demonstration of polymerization of polypyrrole in solution when $FeCl_3$ is used as an intiator.

FIG. 14 illustrates polymerization of pyrrole initiated by adding a conventionally used oxidizing agent, $FeCl_3$, for comparison. As shown in FIG. 14, polymerization occurred primarily in solution phase as expected (due to the density of $FeCl_3$, polymerization initiates from the bottom of the solution). However, the color of the majority of the silica powders remained white even after 30 min of experiments because the diffusion of $FeCl_3$ into the pores and therefore polymerization of polypyrrole within the pores are significantly limited.

A non-limiting example of preparing MSU-H/ppy involves dispersing 200 mg silica in 100 mL distilled water by stiffing for two hours and adding 0.7 mL pyrrole solution. (The final concentration of pyrrole in the 100 mL solution was 0.1 M). For the maximum adsorption of polypyrrole in the mesopores, stirring was continued for several hours. Polymerization was initiated upon addition of 0.69 g of $NaNO_2$. After one day of stirring, the composites were collected by filtering the solution using membrane filter with 0.2 micron pore size and washing with deionized water. For purification, the composites were re-dispersed in 100 mL deionized water for filtering and washing twice more. The products were dried under vacuum at 50° C. for 72 hours before further characterization. The polypyrrole content in the resulting MSU-H/polypyrrole composites is approximately 3.1 wt %, which was estimated by thermal gravimetric analysis (TGA). The content of the polymer in the composites can vary depending on the details of the experimental conditions.

Figure 15:
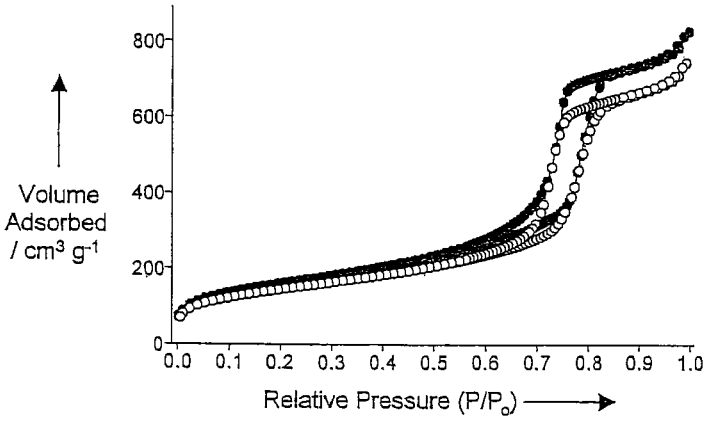
FIG. 15 illustrates the nitrogen adsorption/desorption isotherm of the mesoporous silica substrate (solid dot) and the silica-polypyrrole composite (hollow dot) obtained through the second embodiment of the disclosed method.

Turning now to FIG. 15, the presence of polypyrrole coating on the mesopore walls and the accessibility of the pores in the composite samples may be confirmed by nitrogen adsorption/desorption study. As shown in FIG. 15, the polypyrrole-silica composite exhibites type IV isotherm with a narrow H1-type hysteresis loop that is very similar to that of the pristine silica, which indicates that the cylindrical (mesopore) walls of the silica may be uniformly coated with poypyrrole and the mesoporous structure remains substantially unaffected after the polymer coating.

Figure 16:
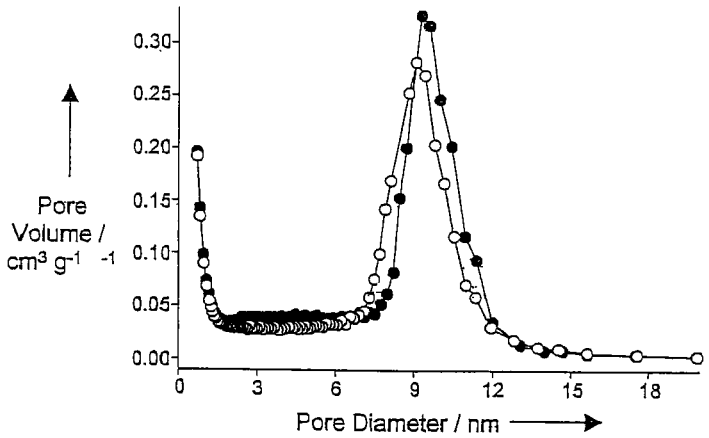
FIG. 16 illustrates the pore size distribution of the mesoporous silica substrate (solid dot) and the silica-polypyrrole composite (hollow dot) obtained through the second embodiment of the disclosed method.

Further, as illustrated in FIG. 16, the pore size distribution curves of the silica, determined by Barrett-Joyner-Halenda (BJH) analysis, show a very slight decrease in median pore size from 9.27 to 9.06 nm with a very similar full width at half maximum (FWHM), which confirms again the uniformity and thinness of the interchannel polymer coating. The slight reduction of the pore sizes and pore volumes observed in the composite samples agrees well with the small amount of polymer present in the composite sample. It also indicates that the composites possess a high pore volume that can be used for various applications.

In order to measure the conductivity of the composite sample, MSU-H/polypyrrole composite powders are prepared as a pellet. As illustrated in FIG. 17 (insert), the resulting pellet is mounted on an ITO substrate with silver paste. Silver contacts are placed on the pellet and IV measurements are carried out using two probes. A linear correlation of the I-V curve shown in FIG. 17 is then used to calculate the conductivity of the composite sample, which provided $8\times10^{-6}$ S/cm. Considering that the composite contains only 3.1 wt % polypyrrole and that the conductivity was measured using a powder pellet containing significant grain boundary areas, the conductivity data confirms that polypyrrole in the composite formed a thin but continuous coating layer on the mesoporous silica surface because formation of irregular or isolated polypyrrole islands or aggregates on the silica surface with 3.1 wt % content would not result in a measurable conductivity value. Thus, higher conductivity value may be achieved when composite structures are formed using monolithic mesoporous silica materials, or the polypyrrole content in the composite is increased by altering polymerization conditions.

Although mesoporous silica is used as the substrate with proton-donating surface in the above-described examples, other proton-donating surface may also be used. For example, the substrate may have surface groups other than hydroxyl to donate the proton. Moreover, a non-proton-donating surface may be transformed into a proton-donating surface simply by immersing the substrate in an acidic composition and transferring the substrate to the deposition composition, where the acidic protons adhered to the substrate reacts with the nitrosyl precursor to generate the nitrosyl ion.

While only certain embodiments have been set forth, alternative embodiments and various modifications will be apparent from the above descriptions to those skilled in the art. For example, although the applications of the substrate-conducting polymer composite in battery electrodes is disclosed herein, it is to be understood that such composite may also be used in other areas including, but not limited to catalysis, chemical and bio sensors, drug delivery, fuel cells, electrochromic device, actuators, field emission displays, supercapacitors, photovoltaics, transistors, data storage, surface protection, transparent conducting materials, substitutes for carbon nanomaterials, etc. These and other alternatives are considered equivalents and within the spirit and scope of this disclosure.

What is claimed:

1. A method of forming a conductive polymer deposit on a substrate, the method comprising:

preparing a composition comprising monomers of the conductive polymer and a nitrosyl precursor, the nitrosyl precursor being a nitrite;

contacting the substrate with the composition so as to allow formation of nitrosyl ion from the nitrite only on the exterior surface of the substrate, the substrate comprising a proton-donating surface or a proton-preloaded surface that serves as the only proton source used to convert the nitrite to the nitrosyl ion; and allowing the monomers to polymerize into the conductive polymer, the polymerization being initiated by the nitrosyl ion generated at the exterior surface of the substrate, and the conductive polymer being deposited only on the exterior surface of the substrate.

2. The method of claim 1, wherein the proton-donating surface comprises a metal oxide surface with surface hydroxyl groups.

3. The method of claim 1, wherein the substrate is a mesoporous silica or aluminosilica material.

4. The method of claim 1, wherein the nitrosyl precursor reacts with the proton from the surface of the substrate to produce the nitrosyl ion.

5. The method of claim 1, wherein the monomers comprises pyrrole or thiophene.

6. A method of forming a conductive polymer deposit on a working electrode, the method comprising:

preparing a composition comprising monomers of the conductive polymer and a nitrosyl precursor, the nitrosyl precursor being a nitrate;

contacting the working electrode with the composition while applying a cathodic bias at the working electrode so as to allow formation of nitrosyl ion from the nitrate only at the exterior surface of the working electrode;

allowing the monomers to polymerize into the conductive polymer at the working electrode having the cathodic bias applied thereto, the polymerization being initiated by the nitrosyl ion generated at the exterior surface of the working electrode; and allowing cathodic deposition of the conductive polymer on the working electrode.

7. The method of claim 6, wherein the working electrode reduces the nitrate to a nitrite when the working electrode contacts the composition, and wherein the nitrite reacts with a proton in solution to form the nitrosyl ion that initiates the polymerization of the conductive polymer at the exterior surface of the working electrode.

8. The method of claim 7, wherein the electric potential bias is variable.

9. The method of claim 7, wherein the monomers comprises pyrrole or thiophene.

10. The method of claim 7, wherein the composition further comprises a metal salt and the cathodic bias applied to the working electrode allows cathodic deposition of inorganic particles derived from the metal salt with the conductive polymer on the working electrode.

* * * * *